US005126010A

United States Patent [19]

Kobayashi et al.

[11] Patent Number: 5,126,010

[45] Date of Patent: Jun. 30, 1992

[54] INK-JET RECORDING SHEET

[75] Inventors: Akira Kobayashi, Aichi; Makiko Tokita, Chiba; Masahiro Nakagawa, Hokkaido; Kenji Yasuda, Chiba, all of Japan

[73] Assignee: Oji Paper Co., Ltd., Tokyo, Japan

[21] Appl. No.: 617,274

[22] Filed: Nov. 21, 1990

Related U.S. Application Data

[63] Continuation of Ser. No. 268,548, Nov. 7, 1988, abandoned.

[30] Foreign Application Priority Data

Nov. 5, 1987 [JP] Japan ..... 62-279527
May 6, 1988 [JP] Japan ..... 63-109112

[51] Int. Cl.[5] ..... B21M 5/00; D21H 1/22

[52] U.S. Cl. ..... 162/135; 162/158; 162/168.2; 162/181.2; 428/481

[58] Field of Search ..... 162/168.2, 181.2, 158, 162/135; 526/307.3; 428/481

[56] References Cited

U.S. PATENT DOCUMENTS 4,474,859 10/1984 Oshima et al. ..... 428/481
4,610,801 9/1986 Mathews et al. ..... 162/181.2
4,717,758 1/1988 Ogawa et al. ..... 526/307.3
4,925,530 5/1990 Sinclair et al. ..... 162/181.2

FOREIGN PATENT DOCUMENTS 0169250A of 0000 European Pat. Off. .
0228801A of 0000 European Pat. Off. .
0228801 11/1986 European Pat. Off. .

*Primary Examiner*—Steve Alvo
*Attorney, Agent, or Firm*—Wenderoth, Lind & Ponack

[57] ABSTRACT

An ink-jet recording sheet that contains as main ingredients 69–95% wood pulp and 4–30 wt % precipitated calcium carbonate and which has a Stöckigt sizing degree of 2–25 seconds as measured for a basis weight of 64 g/m$^2$, or a Stöckigt sizing degree ranging from $5\times$(basis weight/64)$^2$ to $25\times$(basis weight/64)$^2$ at a water extracting pH of 4.5–7.5. This sheet allows a clear color to develop and provides an image having circular dots and sharply defined edges. This sheet may also incorporate a cationic synthetic polymer and an alkylketene dimer.

4 Claims, No Drawings

INK-JET RECORDING SHEET

This application is a continuation of now abandoned application, Ser. No. 07/268,548 filed on Nov. 7, 1988, now abandoned.

BACKGROUND OF THE INVENTION

This invention relates to a filled type ink-jet recording sheet. More particularly, it relates to an ink-jet recording sheet for use in an ink jet recording system that employs a water-based ink, the sheet exhibiting a high rate of absorption of ink deposited on the recording sheet so as to allow a clear color to develop, providing an image having circular dots and sharply defined edges, having a high surface strength and the same touch and feel during use as plain paper, and being able to record images with high resolution at high speeds.

In order for an ink-jet recording system to be able to produce high quality recorded images, it is required that the substrate employed be such that the ink deposited on the surface of the recording sheet which is composed mainly of paper spreads to form a true circle and is absorbed quickly in a controlled manner without becoming irregularly spread on the surface, and that the surface structure be such as to promote coloration of the deposited ink. Various proposals have so far been put forward with a view to realizing these requirements.

For example, it has been reported that when a pigment such as silica is coated on one surface of paper together with a binder, the whiteness and clarity of silica are exploited to provide better color formation and ink absorption than in the case of plain paper, and in another report, the use of high-size paper, and in still another report lowsize (Stockigt sizing degree of no more than 1 second) or non-sized paper as base paper for coating was proposed (see Japanese Patent Publication No. 27588/1985).

However, coated type ink-jet recording paper has a peculiar surface on the coated layer which is mainly composed of silica and the loss of the natural feel of the paper makes it unpopular in printing and business form applications. The coated type ink-jet recording paper also has problems in use such as low surface strength and threading speed. Therefore, uncoated fine paper has conventionally been used in the above-mentioned applications.

It is known that uncoated ink-jet recording paper can be produced with a liquid-absorbing pigment such as silica being incorporated in the process of papermaking or without adding any sizing agent. However, when ink is deposited on non-sized ink-jet recording paper having a liquid-absorbing pigment incorporated therein, it is extensively absorbed by the paper layer to be blocked by pulp fibers and pigment particles, thereby producing an unsharp or less bright color in the layer where ink is absorbed. In addition, the spread and shape of ink dots are often irregular and lack sharpness, and the image obtained is not as sharp as what is produced from coated type paper that achieves selective ink absorption by virtue of the surface layer.

Substantially similar problems, namely, diffuse edges and irregular dot shapes, have occurred when a coated layer is formed on the non-sized paper shown in Japanese Patent Publication No. 27588/1985.

In the presence of a fairly large amount of a liquid-absorbing pigment, a process of sheet production utilizing a given papermaking method is not consistent and the resulting irregular distribution of pigment in the paper layer can cause unevenness or variations in the color of images or troubles in use such as the generation of paper dust.

The use of acidic paper or alkaline paper has also been reported but they involve the disadvantage that the dye of the ink might be decomposed or otherwise deteriorate by the action of acids or alkalis.

The above-mentioned problems with coated ink-jet printing paper and with filled type paper have chiefly originated because of the absence of thorough reviews concerning any influence on an ink jet image caused by the quality of the structure of a paper layer composed of wood pulp and pigments (which are the essential ingredients of ink-jet printing paper of either coated or filled type) and its physicochemical properties, in particular, the ink absorbing capability typified by sizing degree.

SUMMARY OF THE INVENTION

It is thus an object of the present invention to provide a filled type sheet for ink-jet recording in an ink-jet recording system employing a water-based ink which not only allows the water-based ink to be absorbed quickly within the surface region of the recording sheet, but also provides for good ink image color brightness, the formation of ink dots which are truly circular in shape and the diffusion of which is inhibited, and the formation of sharp-tone images, allowing the production of high-resolution images at high speeds.

It is another object of the present invention to provide an ink-jet recording sheet that is free from the defects of the prior art products, namely, coated type, filled type or non-sized type ink-jet recording paper.

These objects of the present invention can be attained by an ink-jet recording sheet that contains as the main ingredients 69–95 wt % of wood pulp and 4–30 wt % of precipitated calcium carbonate as an incorporated pigment and which is adapted to have a sizing degree in a specified range. Stated more specifically, the present invention relates to an ink-jet recording sheet that contains as the main ingredients 69–95 wt % of wood pulp and 4–30 wt % of precipitated calcium carbonate and which has a Stöckigt sizing degree of 2–25 seconds as measured with respect to a basis weight of 64 g/m$^2$.

If a properly selected internal sizing agent is used, the ink-jet recording sheet of the present invention is capable of attaining even better results. A suitable internal sizing agent is an alkylketene dimer which may be used in the presence of a cationic synthetic polymer serving as a fixing agent.

The present invention also relates to an ink-jet recording sheet that contains as the main ingredients 69–95 wt % of wood pulp and 4–30 wt % of precipitated calcium carbonate together with an incorporated neutral sizing agent, and which has a Stöckigt sizing degree of $5\times(\text{basis weight}/64)^2$ to $25\times(\text{basis weight}/64)^2$ and a water extracting pH of 4.5–7.5 as measured by the method specified in JIS P8133.

The ink-jet recording sheet of the present invention may be provided with a surface layer. A desirable surface layer is one that contains 0.2–5.0 g/m$^2$ of polyvinyl alcohol having a saponification degree of no more than 95 mol %.

The ink-jet recording sheet of the present invention is superior not only in ink absorbency but also in the shape and color of ink dots and thus is suitable for use on an ink-jet printer to produce images of high resolution at high speed without suffering from any of the disadvantages inherent in the prior art.

DETAILED DESCRIPTION OF THE INVENTION

As a result of various studies conducted in order to eliminate the aforementioned problems of the prior art, the present inventors found that such problems could be effectively solved by an ink-jet recording sheet that contains as the main ingredients 69–95 wt % of wood pulp and 4–30 wt % of precipitated calcium carbonate as an filled pigment and which has a Stöckigt sizing degree of 2–25 seconds as measured for a basis weight of 64 g/m$^2$. This sheet is capable of forming color by adsorbing a water-based ink on the surface. It can be produced by the same method as that employed to make fine paper and its appearance is also the same as the latter. Yet, the ink-jet recording sheet of the present invention ensures rapid ink adsorption, formation of bright colors and precise reproduction of ink dots.

The wood pulp which is used as a main ingredient of the sheet of the present invention is common papermaking pulp which can be prepared by bleaching wood pulps.

Precipitated calcium carbonate which is a color developing white pigment having high oil absorbency and a large specific surface area is used as a pigment to be filled in the sheet together with wood pulp. The major component of precipitated calcium carbonate is preferably calcite type particles of a quality that ensures that at least 70% of the particles have a particle size of 0.5–1.5 μm and which has an oil absorbency of 10–80 ml/100 g. It is particularly preferred that the major component of precipitated calcium carbonate is hexagonal prism calcite particles wherein at least 80% of the particles have a particle size of 0.5–1.5 μm and which have an oil absorbency of 30–80 ml/100 g. Precipitated calcium carbonate having such a narrow particle size distribution offers particularly good results for the purpose of improving the shape of ink dots.

Wood pulp and a precipitated calcium carbonate pigment are incorporated in respective proportions of 69–95 wt % and 4–30 wt %. If the loading of precipitated calcium carbonate exceeds 30 wt %, either the color optical density or the natural feel of the paper will be impaired. In addition, troubles affecting quality such as the generation of paper dust might occur. Using precipitated calcium carbonate in an amount exceeding 30% would have no substantial positive influence on such factors as the roundness of ink dots. On the other hand, no substantial improvement can be obtained if the content of precipitated calcium carbonate is less than 4 wt %.

Precipitated calcium carbonate may be filled together with other white pigments. White pigments that are commonly filled in ordinary paper are useful, and they include kaolin, clay, talc, diatomaceous earth, aluminum hydroxide, titanium dioxide, organic pigments (plastic pigments), zeolite, silica, etc. However, these additional white pigments can be filled in amounts of up to 10 wt %.

Internal sizing agents for neutral paper such as alkylketene dimers are used in combination with cationic starch serving as a fixing agent and/or a dispersant. However, the present inventors found that ink dots having a particularly high optical density and a high degree of roundness could be produced by using alkylketene dimer sizing agent in combination with a cationic synthetic polymer used as a dispersant.

The cationic synthetic polymers to be used in the present invention are the following copolymers: a cationic surfactant copolymer having a hydrocarbon group of $C_{4-28}$ and a polymerizable functional group; another copolymer of a cationic monomer and a nonionic monomer. The cationic surfactant having a hydrocarbon group of $C_{4-28}$ and a polymerizable functional group is a quaternary ammonium salt having a hydrocarbon group of $C_{4-28}$ and may be exemplified by highly polymerizable cationic surfactants that are based on acrylic or methacrylic acid, preferably methacrylic acid. A dimethyldiallyl ammonium chloride copolymer is a particularly preferred example.

The other requirement to be satisfied by the ink-jet recording sheet of the present invention is that it have a Stöckigt sizing degree of 2–25 seconds as measured for a basis weight of 64 g/m$^2$. If the Stöckigt sizing degree of the sheet is less than 2 seconds, ink will diffuse or spread uncontrollably or produce a blurred edge and print-through. At the same time, the water proofness of the color image is impaired. If the Stöckigt sizing degree is greater than 25 seconds, ink absorption is retarded and problems such as staining on the ink-jet printer will occur such as to lead to various difficulties in practical use.

The present invention further relates to an ink jet recording sheet that contains as the main ingredients 69–95 wt % of wood pulp and 4–30 wt % of precipitated calcium carbonate together with an internal neutral sizing agent, and which has a Stöckigt sizing degree of $5\times(\text{basis weight}/64)^2$ to $25\times(\text{basis weight}/64)^2$ and a water extracting pH of 4.5–7.5 as measured by the method specified in JIS P8133.

It is normally possible to attain a certain degree of effectiveness by controlling the sizing degree instead of using pigments of the kind commonly employed in ink-jet printing sheets. However, the present inventors found that by incorporating water-soluble aluminum salts to improve the effectiveness of filled precipitated calcium carbonate and by bringing the pH of the paper to the range of from weakly acidic to neutral, the shape of ink dots could be brought closer to a circle, while, at the same time, significantly increasing the color optical density of dots with attendant improvement in optical quality of color images.

The addition of water-soluble aluminum salts such as aluminum sulfate is not required in the process of neutral paper making with neutral sizing agents. However, the present inventors found that a water-soluble aluminum salt incorporated in paper stock in an amount of 0.05–2.5 wt % of the sheet weight improves quality of ink-jet recording sheet. This weakly acidic paper could be made from this paper stock possessing higher adaptability for ink-jet printing quality and better shelf life than conventional paper. Examples of the water-soluble aluminum salts that can be used in the present invention include aluminum sulfate, polyaluminum chloride and potash alum. If these water-soluble aluminum salts are to be employed, ordinary sizing agents such as alkylketene dimers or alkenylsuccinic anhydrides will suffice.

In the process of papermaking, a water-soluble aluminum salt is preferably incorporated in an amount of 0.05–2.5 wt % in paper stock so as to bring its pH to the range of 4.5–7.5 as measured by a cold water extraction method. With paper sheets having the same capacity of absorption, their Stöckigt sizing degree is known to be generally in proportion to the square of the fraction of their basis weight to a paper having a basis weight of 64 g/m². According to the present invention, the Stöckigt sizing degree of paper is adjusted to be within the range of from $5\times(\text{basis weight}/64)^2$ to $25\times(\text{basis weight}/64)^2$.

The sheet of the present invention is itself capable of ink reception and has no particular need to be provided with a separate ink-receiving layer such as a pigment coated layer. This sheet is made of weakly acidic paper that has a water-soluble aluminum salt incorporated therein to provide a cold water extracting pH in the range of 4.5–7.5 and it is adjusted to have a Stöckigt sizing degree of 5–25 seconds as measured for a basis weight of 64 g/m². The sheet of the present invention can be produced by the same method as what is employed to make fine paper and its appearance is also the same as the latter. Yet, this sheet adsorbs a water-based dyeing ink on its surface and enables formation of bright colors by dyes and precise reproduction of ink dots to the level of quality that commercially acceptable products are required to exhibit.

The ink-jet recording sheet of the present invention can be produced by a standard papermaking process using the wood pulp described herein together with a suitable pigment. Wood pulp may optionally be used in combination with synthetic fibers and pulp having high degrees of whiteness. Additives that are commonly employed in papermaking are also usable and they include dry strength resins, retention aids, wet strength resins, dyes, etc.

The sheet of the present invention preferably has a thickness of 20–200 μm and a basis weight of 20–180 g/m². Ink-jet printers require sheets having a high degree of surface smoothness, so the sheet of the present invention is preferably smoothed to a Bekk smoothness of 50 seconds or more by a suitable treatment such as machine calendering or supercalendering.

A surface layer may be provided on the ink-jet recording sheet of the present invention by treatment with a suitable medium such as a surface sizing agent. The surface sizing agents that are employed either individually or in combination with starches to form a surface layer in common papermaking processes are various grades of polyvinyl alcohol having a saponification degree of at least 98 mol % and these are generally referred to as "completely saponified products". However, the present inventors found that ink dots having a particularly high color optical density and a high degree of roundness could be produced by increasing the affinity for water-based ink through the use of polyvinyl alcohol having a low degree of saponification of no higher than 95 mol %, preferably in the range of 80–90 mol %. It is therefore preferable for the surface layer described above to contain polyvinyl alcohol with a low degree of saponification. The resulting sheet is capable of forming color by adsorbing a water-based ink on its surface. It can be produced by the same method as that employed to make fine paper and its appearance is also the same as the latter. Yet, the sheet of the present invention ensures formation of bright colors by dyes and precise reproduction of ink dots to the high quality level, thereby enabling ink-jet recording of images at high resolution.

The following examples are provided for the purpose of further illustrating the present invention but are in no way to be taken as limiting.

EXAMPLE 1

Ten parts of a filler or precipitated calcium carbonate (calcite) comprising particles with an average size of 0.8 μm and at least 80% of which ranged from 0.5–1.5 μm in size were mixed in a high-speed disperser in the presence of a dispersant and water. The mixture was then added to 100 parts of bleached kraft pulp that had been beaten for 20 minutes. Also added were 0.05 parts of a sizing agent (Fibran 81 of Oji National Co., Ltd.), 1 part of cationic starch and 0.002 parts of Methyl Violet Blue. The resulting mixture was diluted with water to make paper stock having a concentration of 0.03%.

This stock was processed on a multi-cylinder Fourdrinier paper machine into a (65 g/m²) ink-jet recording sheet having a whiteness of 90%. The ash (calcium carbonate) content of the sheet was 8.5%. It had a Stöckigt sizing degree of 7 seconds as measured for a basis weight of 64 g/m².

EXAMPLE 2

Paper was made by the same method and from the same formulation as those employed in Example 1 except that precipitated calcium carbonate (calcite) was used in an amount of 20 parts. An ink-jet recording sheet was prepared by size-pressing the paper with a 4% aqueous solution of polyvinyl alcohol (88 mol % saponification and average polymerization degree of 1700) in a coating weight of 1 g/m². This sheet had a Stöckigt sizing degree of 19 seconds as measured for a basis weight of 64 g/m².

EXAMPLE 3

Paper was made by the same method and from the same formulation as those employed in Example 2. An ink-jet recording sheet was prepared by size-pressing the paper with a 4% aqueous solution of polyvinyl alcohol (99 mol % saponification and average polymerization degree of 1700) in a coating weight of 1.0 g/m². This sheet had a Stöckigt sizing degree of 19 seconds as measured for a basis weight of 64 g/m².

EXAMPLE 4

The following filler and additives were added to 100 parts of bleached kraft pulp that had been beaten for 20 minutes.

| | Additives | Parts |
|---|---|---|
| Filler: | precipitated calcium carbonate (Albafil of Pfizer Inc.) | 10 |
| Sizing agent: | alkylketene dimer | 0.05 |
| Fixing agent: | polyethyleneimine | 0.02 |
| Dry strength resin: | Polystron 705 of Arakawa Kagaku K.K. | 0.2 |
| Retention aid: | Percol 57 of Allied Colloids Limited | 0.05 |

The resulting mixture was diluted to make paper stock having a concentration of 0.03%, which was processed into fine paper on a multi-cylinder Fourdrinier paper machine. An ink-jet recording sheet was prepared by size-pressing the paper with a 4% aqueous solution of polyvinyl alcohol (88 mol % saponification; GH17 of The Nippon Synthetic Chemical Industry Co., Ltd.) in a coating weight of 1 g/m². This sheet had the following characteristics:

| | |
|---|---|
| Ash (calcium carbonate) content | 8.5% |
| Basis weight | 64 g/m² |
| Stockigt sizing degree | 7 sec |

EXAMPLE 5

Paper stock containing the following additives was processed into paper as in Example 4:

| | Additives | Parts |
|---|---|---|
| Filler: | precipitated calcium carbonate (Albafil of Pfizer Inc.) | 40 |
| Sizing agent: | alkylketene dimer (Saireen H30 of Kao Corp.) using cationic synthetic polymer as fixing agent | 0.20 |
| Dry strength resin | Polystron 705 of Arakawa Kagaku K.K. | 0.2 |
| Retention aid | Percol 57 of Allied Colloids Limited | 0.05 |

An ink-jet recording sheet was prepared by sizepressing the paper with polyvinyl alcohol as in Example 4 in a coating weight of 1 g/m². This sheet had the following characteristics:

| | |
|---|---|
| Ash (calcium carbonate) content | 28% |
| Basis weight | 64 g/m² |
| Stockigt sizing degree | 24 sec |

EXAMPLE 6

Paper stock containing the following additives was processed into paper as in Example 4:

| | Additives | Parts |
|---|---|---|
| Filler: | precipitated calcium carbonate (PC of Shiraishi Chemical Co., Ltd.) | 40 |
| Sizing agent | alkylketene dimer | 0.05 |
| Fixing agent | acrylamide/dimethyldiallyl ammonium chloride copolymer (PAS-J11 of Nitto Boseki Co., Ltd.) | 0.01 |
| Dry strength resin: | Polystron 705 of Arakawa Kagaku K.K. | 0.2 |
| Retention aid | Percol 57 of Allied Colloids Limited | 0.05 |

An ink-jet recording sheet was prepared by sizepressing the paper with polyvinyl alcohol as in Example 4 in a coating weight of 1 g/m². The sheet had the following characteristics:

| | |
|---|---|
| Ash (calcium carbonate) content | 20% |
| Basis weight | 64 g/m² |
| Stockigt sizing degree | 4 sec |

EXAMPLE 7

Fine paper was made by the same method and from the same formulation as those employed in Example 4. Without being size-pressed, this paper was immediately used as an ink-jet recording sheet. The characteristics of the sheet were as follows:

| | |
|---|---|
| Ash (calcium carbonate) content | 8.5% |
| Basis weight | 64 g/m² |
| Stockigt sizing degree | 10 sec |

EXAMPLE 8

Ten parts of a filler or precipitated calcium carbonate (Albafil of Pfizer Inc.) were mixed in a high-speed disperser in the presence of a dispersant and water. The mixture was then added to 100 parts of bleached hardwood kraft pulp (CSF, 450 ml) that had been beaten for 20 minutes. Also added were 0.05 parts of a neutral sizing agent [ASA (alkenylsuccinic anhydride): Fibran 81 of Oji National Co., Ltd.], 1 part of cationic starch, 5.0 parts of aluminum sulfate, and 0.002 parts of Methyl Violet Blue. The resulting paper stock was processed on a multicylinder Fourdrinier paper machine into a (64 g/m²) ink-jet recording sheet having a whiteness of 88%. This sheet had a cold water extracting pH of 6.0 and a Stöckigt sizing degree of 8 seconds.

EXAMPLE 9

The paper prepared in Example 8 was size-pressed with a 4% aqueous solution of polyvinyl alcohol (98% saponification; K-17 of The Nippon Synthetic Chemical Industry Co., Ltd.) in a coating weight of 1 g/m² to prepare an ink-jet recording sheet. This sheet had a cold water extracting pH of 6.0 and a Stöckigt sizing degree of 15 seconds.

COMPARATIVE EXAMPLE 1

An ink-jet recording sheet was prepared by the same method and from the same formulation as those employed in Example 1 except that no sizing agent was added. This sheet had an ash (calcium carbonate) content of 8% and a Stöckigt sizing degree of no more than 1 second as measured for a basis weight of 64 g/m².

COMPARATIVE EXAMPLE 2

An ink-jet recording sheet was prepared by the same method and from the same formulation as those employed in Example 1 except that calcium carbonate was replaced by 15 parts of fine particulate silicic acid (Tokusil GUN). This sheet had an ash content of 11% and a Stöckigt sizing degree of 4 seconds as measured for a basis weight of 64 g/m².

EXAMPLE 10

Paper stock containing the following additives was processed into paper as in Example 4:

| | Additives | Parts |
|---|---|---|
| Filler: | precipitated calcium carbonate (Albafil of Pfizer Inc.) | 10 |
| Sizing agent: | alkylketene dimer | 0.01 |
| Fixing agent: | cationic starch (CATO-F of Oji National Co., Ltd.) | 1.0 |
| Dry strength resin: | Polystron 705 of Arakawa Kagaku K.K. | 0.2 |
| Retention aid: | Percol 57 of Allied Colloids Limited | 0.05 |

An ink-jet recording sheet was prepared by sizepressing the paper with polyvinyl alcohol as in Example 4 in a coating weight of 1 g/m². This sheet had the following characteristics:

| | |
|---|---|
| Ash (calcium carbonate) content | 8% |
| Basis weight | 64 g/m² |
| Stockigt sizing degree | 2 sec |

COMPARATIVE EXAMPLE 3

Paper stock containing the following additives was processed into paper as in Example 4:

| | Additives | Parts |
|---|---|---|
| Filler: | precipitated calcium carbonate (PC of Shiraishi Chemical Co., Ltd.) | 40 |
| Cationic starch. | (CATO-F of Oji National Co., Ltd.) | 1.0 |
| Dry strength resin | Polystron 705 of Arakawa Kagaku K.K. | 0.2 |
| Retention aid | Percol 57 of Allied Colloids Limited | 0.05 |

An ink-jet recording sheet was prepared by size-pressing the paper with polyvinyl alcohol as in Example 4 in a coating weight of 1 g/m². This sheet had the following characteristics:

| | |
|---|---|
| Ash (calcium carbonate) content | 18% |
| Basis weight | 64 g/m² |
| Stockigt sizing degree | <1 sec |

EXAMPLE 11

An ink-jet recording sheet was prepared by the same method and from the same formulation as those employed in Example 8 except that aluminum sulfate was not added. This sheet had a cold water extracting pH of 7.8 and a Stöckigt sizing degree of 2 seconds.

COMPARATIVE EXAMPLE 4

An ink-jet recording sheet was prepared by the same method and from the same formulation as those employed in Example 8 except that aluminum sulfate was not added and that calcium carbonate was replaced by 15 parts of fine particulate silicic acid. This sheet had a a cold water extracting pH of 7.6 and a Stöckigt sizing degree of 4 seconds.

EXAMPLE 12

The paper made by the same method and from the same formulation as those employed in Example 11 was size-pressed with a 6% aqueous solution of polyvinyl alcohol (98% saponification K-17 of The Nippon Synthetic Chemical Industry Co., Ltd.) in a coating weight of 1.0 g/m², so as to prepare an ink-jet recording sheet. This sheet had a cold water extracting pH of 7.7 and a Stöckigt sizing degree of 13 seconds.

The adaptability of the samples to use as ink-jet recording sheets was evaluated on a commercial ink-jet printer with respect to ink absorbency, dot shape and the brightness of color. Ink absorbency was evaluated by measuring the time in seconds required for running ink in a printed area to dry. The shape of dots was evaluated by observing the dots formed by projecting ink onto the sheet on the ink-jet printer.

The results are shown in Table 1

What is claimed is:

1. An ink-jet recording sheet for producing high resolution images comprising a base layer and a surface layer, said base layer comprising as main ingredients 69-95 wt % of wood pulp and 4-30 wt % of precipitated calcium carbonate, wherein said precipitated calcium carbonate is calcite comprising particles at least 70% of which have a particle size of 0.5-1.5 μm and which has an oil absorbency of 10-80 ml/100 g, and said base layer further comprising an alkylketene dimer and a cationic synthetic polymer, wherein said cationic synthetic polymer is selected from the group consisting of a cationic surfactant copolymer having a hydrocarbon group of $C_{4-28}$ and a polymerizable functional group, and a copolymer of a cationic monomer with a nonionic monomer, said surface layer comprising a polyvinyl alcohol with no more than 95 mol % saponification in an amount of 0.2-5.0 g/m², and said-ink jet recording sheet having a Stöckigt sizing degree of 2-25 seconds relative to a paper having a basis weight of 64 g/m².

2. An ink-jet recording sheet according to claim 1 which contains the alkylketene dimer in an amount of 0.05-0.5 g/m².

3. An ink-jet recording sheet according to claim 1 wherein the cationic synthetic polymer is a dimethyldiallyl ammonium chloride copolymer.

4. An ink-jet recording sheet for producing high resolution images comprising a base layer and a surface layer, said base layer comprising as main ingredients 69-95 wt % of wood pulp and 4-30 wt % of precipitated calcium carbonate, wherein said precipitated calcium carbonate is calcite comprising particles at least 70% of which have a particle size of 0.5-1.5 μm and which has an oil absorbency of 10-80 ml/100 g, and said base layer further comprising an alkylketene dimer and a cationic synthetic polymer, wherein said cationic synthetic polymer is selected from the group consisting of a cationic surfactant copolymer having a hydrocarbon group of $C_{4-28}$ and a polymerizable functional group, and a copolymer of a cationic monomer with a nonionic monomer, said surface layer comprising a polyvinyl alcohol with no more than 95 mol % saponification in an amount of 0.2-5.0 g/m², and said ink-jet recording sheet having a Stöckigt sizing degree of $5\times$(basis weight of said recording sheet/64)$^2$ to $25\times$(basis weight of said recording sheet/64)$^2$ and a water extracting pH of 4.5-7.5 as measured by the method specified in JIS P8133.

* * * * *